United States Patent [19]

Petrov et al.

[11] 4,117,654

[45] Oct. 3, 1978

[54] METHOD OF AND APPARATUS FOR THE CONTROL OF COMPOSITE EFFECT YARNS

[75] Inventors: Georgi Mitev Petrov; Blagoy Alexandrov Andonov; Svetozar Paissiev Trayanov; Georgi Dimitrov Georgiev, all of Sofia, Bulgaria

[73] Assignee: Institute Po Obleklo I Textil, Sofia, Bulgaria

[21] Appl. No.: 852,616

[22] Filed: Nov. 18, 1977

[51] Int. Cl.[2] ..... D01H 13/22; D01H 13/16

[52] U.S. Cl. ..... 57/19; 57/80

[58] Field of Search ..... 57/3, 6, 18, 19, 78, 57/80, 81, 82, 83, 156, 160; 28/222, 225, 227

[56] References Cited

U.S. PATENT DOCUMENTS

| | | | |
|---|---|---|---|
| 2,137,613 | 11/1938 | Hill et al. | 28/225 |
| 2,179,498 | 11/1939 | Duncklee et al. | 57/83 |
| 2,419,518 | 4/1947 | Eichinger | 57/81 X |
| 3,149,394 | 9/1964 | Doyle | 28/225 |
| 3,247,662 | 4/1966 | Jeggli | 57/80 X |
| 3,868,812 | 3/1975 | Chavanoz | 57/160 X |
| 3,913,308 | 10/1975 | Lamaire | 57/160 X |
| 3,928,957 | 12/1975 | Petrov et al. | 57/160 X |

FOREIGN PATENT DOCUMENTS

| | | | |
|---|---|---|---|
| 990,017 | 4/1965 | United Kingdom | 57/19 |

*Primary Examiner*—Donald Watkins

[57] ABSTRACT

Method of and apparatus for the control of composite effect (fancy) yarns with enlargements or "stitches", twisted by means of a hollow spindle. A base thread and an effective thread are combined and fed into the rotating hollow spindle where they are met with a tie thread fed from a package on the spindle. The resulting yarn is fed through pressing rollers past a small hook, through a yarn guide, and thence to a yarn coiling means. A tensiometer is disposed to engage the yarn in the span thereof between the pressing rollers and the small hook. If either the tie thread or the base thread should break, the enlargements on the effecting thread are larger than normal, whereby some of such enlargements are caught by the small hook and the winding of the finished yarn by the coiling means is interrupted. The pressing rollers continue to supply the other threads, and thus there is a reduction of the tension in the span of the thread engaged by the tensiometer. The tensiometer then functions to stop one or more of the driven parts of the machine.

8 Claims, 1 Drawing Figure

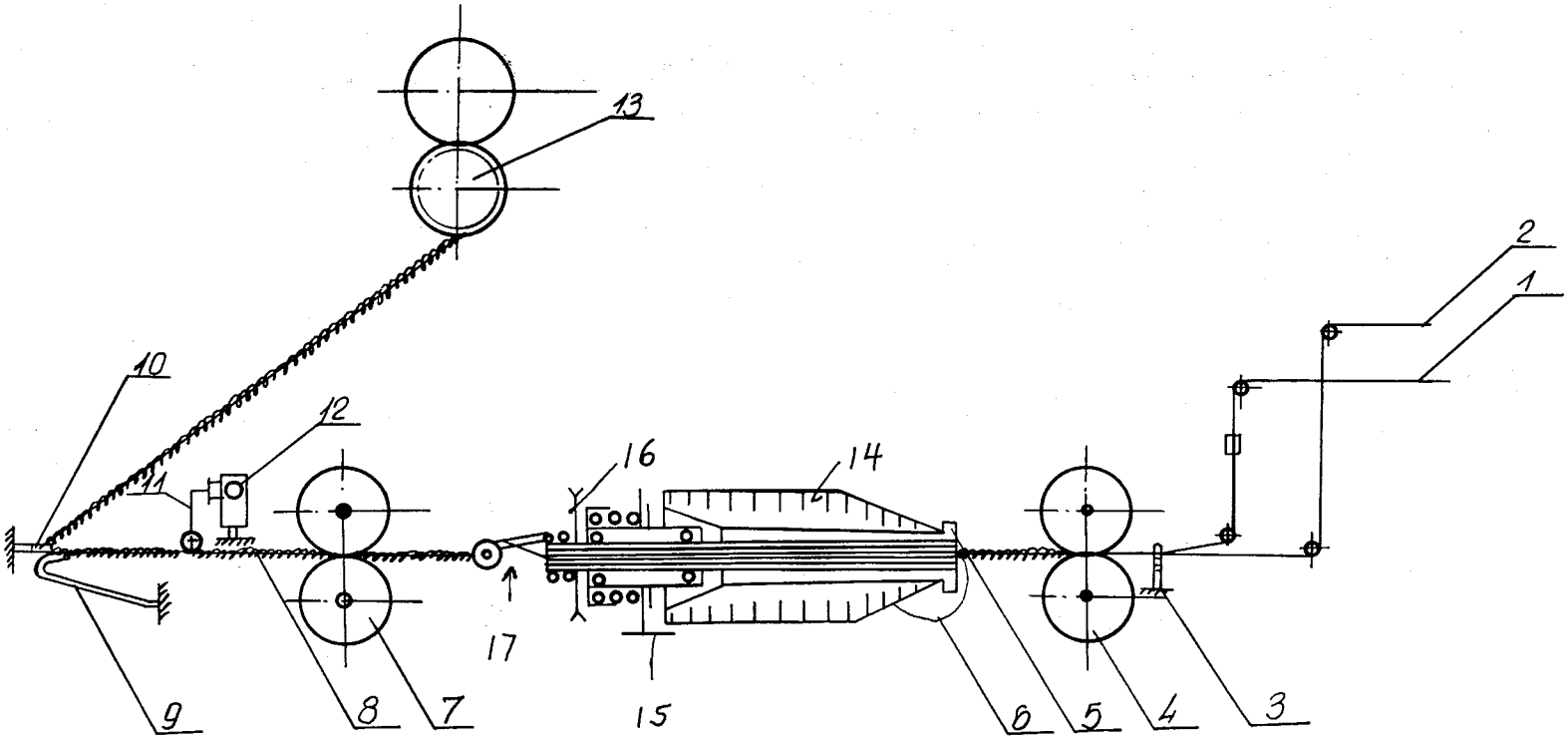
1
2
3
4
5
6
7
8
9
10
11
12
13
14
15
16
17

METHOD OF AND APPARATUS FOR THE CONTROL OF COMPOSITE EFFECT YARNS

This invention relates to a method of and apparatus for controlling composite effect (fancy) yarns with enlargements for "stitches", twisted by means of a hollow spindle.

In a known method for the control of composite effect yarns twisted by a hollow spindle each of the components included in the composite yarn is controlled individually and separately from the remaining components. For this purpose there are provided protective devices in the path of each one of the components, such protective devices reacting, for example, in the case of a reduction of the tension of the material, of lack of supply, or of breaking of the material. The disadvantage of this method of control lies in the fact that it is difficult to follow directly the path of the thread unwinding freely from the hollow spindle. This requires the use of a complex and expensive automation system, which nevertheless does not function in an entirely satisfactory manner.

The present invention has among its objects the provision of a method of and an apparatus for interrupting the supply of material in the case of the breaking of the base thread, as well as that of the breaking of the tie thread being unwound from the hollow spindle.

This object is achieved by the direct sensing of a finished composite effect yarn, the tension of which is varied by retaining the enlargements or stitches formed by the effecting thread.

The stitches or enlargements of the composite effect yarn are retained by a small hook when either the base or the tie thread breaks. Such small hook is disposed in advance of a yarn guard, immediately downstream of the yarn guide there being disposed a contact tensiometer provided with a sensing arm which is in thrusting engagement with the finished composite effect yarn. When the tensiometer senses a lessening of the tension in the span of the composite yarn which it engages, it functions to stop one or more of the means supplying the various yarns to the system.

For a better understanding of the invention, reference should be made to the accompanying drawing, in which:

There is schematically illustrated a preferred embodiment of apparatus in accordance with the invention.

An effecting thread 1 and a base thread 2 are pulled from sources of supply (not shown) to pass through a common thread guide 3 by a set of driven pressing rollers 4. Combined threads 1 and 2 pass through a driven hollow spindle where they are met by a tie thread 6 which is supplied from a package 14 which is non-rotatably held on the spindle by an unbalanced weight 15, as shown. The hollow spindle is driven in a conventional manner by a belt (not shown) passing about a pulley 16 connected to the spindle.

The combined threads 1, 2 and 6 pass outwardly from the left hand end of the spindle through a yarn guide 17 and thence to a pair of driven pressing rollers 7. From the rollers 7 the composite effect yarn 8 travels to a yarn guide 10 and thence to a driven yarn coiling means 13. Immediately downstream of the yarn guide 10 there is disposed a small hook 9 which is open in a direction opposite the direction of travel of yarn 8, the open end of the hook normally not engaging such yarn but being positioned to catch one or more enlargements on the yarn when such enlargements become abnormally large upon the breaking of the tie thread 6 or the breaking of the base thread 2.

When one or more enlargements of the yarn 8 are caught by the hook 9 the winding of the finished yarn 8 by the coiling means 13 is interrupted. The pressing rollers 7, however, continue to supply base thread 2 and effecting thread 1, when tie thread 6 breaks, and continue to supply effecting thread 1 and tie thread 6, when base thread 2 breaks. In either of these cases, there is a reduction in the tension of the yarn 8 in the span thereof between the pressing rollers 7 and the yarn guide 10.

A tensiometer 12 with a yarn engaging, tension-sensing arm 11 is disposed between the pressing roller 7 and the yarn guide 10. Upon breaking of either the tie thread 6 or the base thread 2, the sensing arm of the tensiometer is deflected and one or more motors (not shown) of the machine are stopped. Such motors may be, for example, that driving the pressing rollers 4, that driving the presser rollers 7 and that driving the coiling means 13.

The hook 9 is disposed a short distance downstream of the yarn guide 10, as shown. As an example only, the open end of the hook 9 may be disposed at a distance of 0.5 mm downstream of such yarn guide.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A method of controlling composite effect yarns with enlargements, such yarns being formed by twisting components thereof by a driven hollow spindle, comprising feeding the composite effect yarn from the spindle by driven yarn feeding means which forward the yarn under tension to a yarn guide, immediately upstream of the yarn guide catching yarn having abnormally large enlargements so as at least to slow its forward progress, detecting a decrease in tension in the composite effect yarn in the span thereof between the yarn feeding means and the yarn guide upon such slowing of the forward progress of the yarn, and stopping the feeding of the components of the composite effect yarn into the spindle upon such decrease in tension in said span of the composite effect yarn.

2. A method according to claim 1, wherein the composite effect yarn is formed from an effecting thread, a base thread, and a tie thread.

3. A method according to claim 2, wherein the formation of abnormally large enlargements in the composite effect yarn results from the breaking of one of the base thread and the tie thread.

4. A method according to claim 1, wherein the composite effect yarn is slowed by catching one or more enlargements thereof by a hook disposed upstream of and close to the yarn guide.

5. Apparatus for controlling composite effect yarn with enlargements, such yarns being formed by twisting components thereof by a driven hollow spindle, comprising a guide for the composite effect yarn disposed a substantial distance downstream of the driven hollow spindle, driven means for pulling the composite effect yarn from the spindle and forwarding it in a span under tension to the yarn guide, means disposed immediately upstream of the yarn guide for catching composite effect yarn in said span having abnormally large enlargements so as at least to slow its forward progress, means for detecting a decrease in tension in the composite effect yarn in the portion thereof between the yarn feeding means and the means for catching abnormally large enlargements in the composite effect yarn, and means responsive to said tension detecting means to stop the feeding of the components into the spindle upon such decrease in tension in the composite effect yarn.

6. Apparatus according to claim 5, wherein the composite effect yarn is formed from an effecting thread, a base thread, and a tie thread, and comprising means to feed said threads to the hollow spindle.

7. Apparatus according to claim 6, wherein the formation of abnormally large enlargements in the composite effect yarn results from the breaking of one of the base thread and the tie thread.

8. Apparatus according to claim 5, wherein the means for catching yarn having abnormally large enlargements comprises a hook disposed upstream of and close to the yarn guide, siad hook having an open end which is directed opposite the direction of travel of the yarn there past.

* * * * *